US005618249A

United States Patent [19]

Marshall

[11] Patent Number: 5,618,249

[45] Date of Patent: Apr. 8, 1997

[54] UNIDIRECTIONALLY ADJUSTABLY RESISTANT RECOILERS AND PORTABLE EXERCISE DEVICES

[76] Inventor: David R. Marshall, 42206 County Rd. 1, Rice, Minn. 56367

[21] Appl. No.: 486,840

[22] Filed: Jun. 7, 1995

[51] Int. Cl.[6] ..... A63B 69/10

[52] U.S. Cl. ..... 482/127; 482/92; 482/115; 482/124

[58] Field of Search ..... 482/118, 116, 482/2, 127, 129, 124, 114, 108, 115, 54, 139, 120, 106, 72, 130; 362/103; 2/69

[56] References Cited

U.S. PATENT DOCUMENTS

| | | | |
|---|---|---|---|
| 518,967 | 5/1894 | Poole | 482/116 |
| 866,495 | 9/1907 | Marks . | |
| 1,016,493 | 2/1912 | Hackney . | |
| 2,035,010 | 3/1936 | Rawlings . | |
| 2,632,609 | 3/1953 | Kirby . | |
| 3,323,750 | 6/1967 | Worth et al. . | |
| 3,637,159 | 1/1972 | Caramella . | |
| 3,995,853 | 12/1976 | Deluty | 482/116 |
| 4,253,663 | 3/1981 | Hughes | 482/127 |
| 4,300,732 | 11/1981 | Gaeta . | |
| 4,540,173 | 9/1985 | Hopkins, Jr. . | |
| 4,948,119 | 8/1990 | Robertson | 482/116 |
| 5,129,647 | 7/1992 | Castellanos . | |
| 5,141,223 | 8/1992 | Block . | |
| 5,234,395 | 8/1993 | Miller et al. . | |
| 5,294,031 | 3/1994 | Volpei et al. . | |
| 5,328,432 | 7/1994 | Gvoich . | |
| 5,358,461 | 10/1994 | Bailey, Jr. | 482/124 |

OTHER PUBLICATIONS

Information Sheet on Starter Nos. 590694, 590702, 590707, 590712, 590732, 590735, Tecumseh Products Company, Engine and Transmission Group Service Division, Grafton, Wisconsin, Issued May 1994, Revised Aug. 1994.

*Primary Examiner*—Jerome Donnelly
*Attorney, Agent, or Firm*—Martin E. Hsia

[57] ABSTRACT

An upper body exercise device comprising a base (10) on which two adjustably resistant recoilers (20) are mounted is contained in a waist pouch (30). Two extension members (40) extend outwardly and downwardly from the base (10) and pulleys (50) are attached to the outer ends (44) of the extension members. Cords (60) from the recoilers (20) are threaded through the pulleys (50) and handles (70) are provided at the ends. The extension members (40) displace and direct frictional force created by the recoilers (20), and the pouch (30) makes the device easy to put on and take off. The recoilers (20) preferably provide adjustably resistant force against tension applied to the cords (60) and a slight restoring force sufficient to recoil the cords (600 when tension is released. This avoids safety problems with other mechanisms that provide a restoring force equal to the displacing force.

2 Claims, 8 Drawing Sheets

FIG. 4
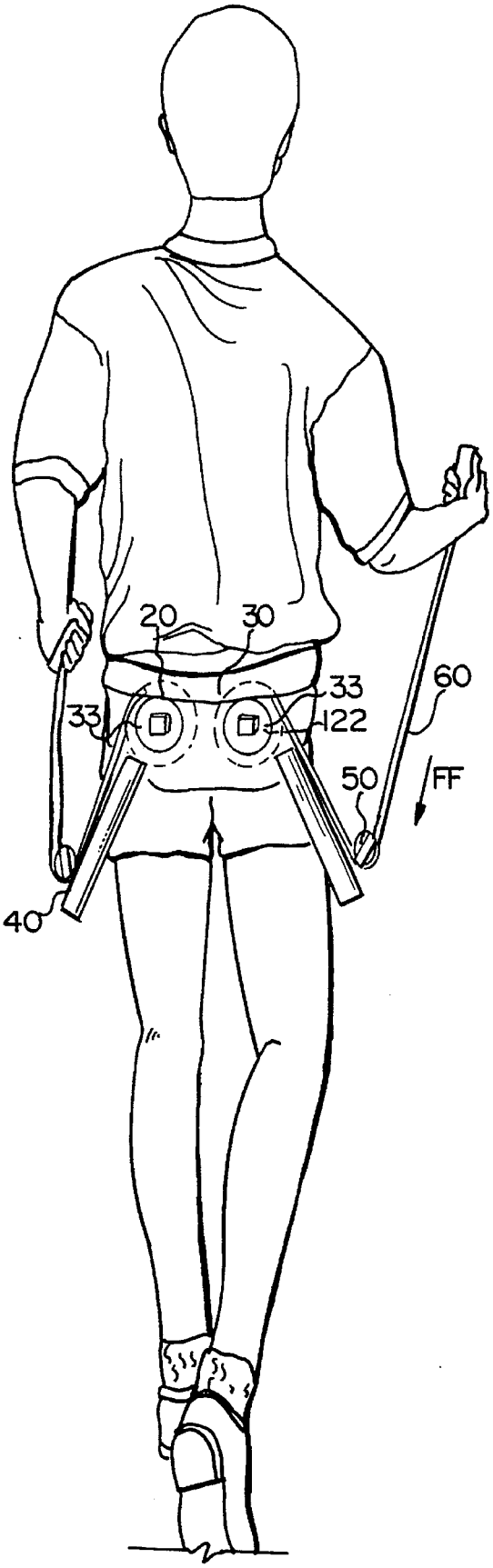
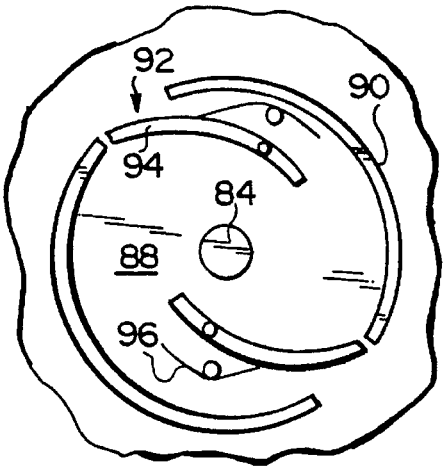
FIG. 3B

UNIDIRECTIONALLY ADJUSTABLY RESISTANT RECOILERS AND PORTABLE EXERCISE DEVICES

TECHNICAL FIELD

This invention relates to unidirectionally adjustably resistant recoilers and portable exercise devices using such recoilers.

Many people exercise to improve their physical fitness and health, often by running, jogging, skating, or some other lower body intensive activity. However, although these lower body intensive activities improve cardiovascular fitness and exercise the lower body, they do not provide substantial exercise for the upper body. Further, any equipment to be used during any of these lower body intensive activities must be easily portable because the user is moving from place to place during these activities.

It is therefore an object of this invention to provide an exercise device with adjustable resistance when tension is applied, but with no resistance, and, preferably, a slight restoring force, when tension is released, to provide an adjustable unidirectional resistance for exercise.

It is a further object of this invention to provide an exercise device that can be used by persons while engaged in lower body intensive activities that will also exercise the upper body.

It is a still further object of this invention to provide such a device that is easily portable so that it can be worn while running, skating, jogging, or engaging in other exercise.

It is a still further object of this invention to provide such an exercise device that is easy to put on and take off and convenient to use.

BACKGROUND ART

U.S. Pat. No. 3,637,159 to Caramella discloses a carrier box latch for suspended bodies, such as electric light pendants, having a rotatable drum and a clutch plate having members engageable with the drum to permit rotation of the drum in one direction and prevent rotation in the other direction, and in which a frictional force can be varied by tightening a screw.

U.S. Pat. No. 4,300,732 to Gaeta discloses a pulley device for suspending height adjustable lamps with an adjustable friction system, wherein a wire winding drum is free to rotate in a rewinding direction, while its rotation is braked and regulated by a friction system in the direction of unwinding.

U.S. Pat. No. 1,016,493 to Hackney discloses a clothes-line reel in a conical housing having a spring that is wound when the clothes-line is pulled out and attached to a distant point. When the clothes-line is released, the spring winds up the reel.

U.S. Pat. No. 2,632,609 to Kirby discloses a fishing line leader reel having a casing which encloses a spring operated reel.

U.S. Pat. No. 3,323,750 to Worth et al. discloses an automatic reel for controlling selective withdrawal, locking and return of a seat belt.

U.S. Pat. No. 5,294,031 to Volpei, et al. discloses a concealed gun holster inside a sports fanny pack.

U.S. Pat. No. 5,358,461 to Bailey, Jr., discloses an exercise device for the upper body including generators attached to bright lights that are turned by coiling and recoiling pull-cords attached to hand grips pulled during the normal arm movement of exercise.

U.S. Pat. No. 5,328,432 to Gvoich discloses an upper body exercising belt comprising a plurality of flexible housings having bores slidingly mounted on a waist-encircling belt, a flexible inelastic rope passing through a series of guide tubes mounted in the bores of the housings, and variable resistance means mounted in the bores.

U.S. Pat. No. 5,234,395 to Miller, et al. discloses an adjustable asymmetric-resistance upper body exerciser.

U.S. Pat. No. 5,141,223 to Block discloses an exercise device including an elastic cord attached to a belt or other device worn at the waist of the user.

U.S. Pat. No. 5,129,647 to Castellanos discloses an elastic resistance exerciser secured at the waist.

U.S. Pat. No. 4,540,173 to Hopkins, Jr., discloses a portable elastic exercising device having a single length of elastic cord twice passed through a flexible sheath to encompass the user's waist.

U.S. Pat. No. 2,035,010 to Rawlings discloses an apparatus for providing physical health treatment comprising a belt structure with flexible strands connected to the belt structure.

U.S. Pat. No. 866,495 to Marks discloses an exercising device comprising an adjustable belt with a slidable ring, an elastic cord passing through the ring and having a handle at one end, a foot piece, and a non-elastic piece connecting the foot piece and the elastic cord.

Most of the exercise devices described above provide resistant forces that are directed from the waist. However, when engaged in running, jogging, skating or other lower body intensive activity, the arms and the hands typically extend through a range of motion that varies in height and direction. Further, several of the above devices employ a single cord with handles at both ends so that forward movement of one hand pulls the other handle backwards, and vice versa. However, this requires that the motions of the right and left hands be synchronized, which is not always possible.

DISCLOSURE OF INVENTION

The present invention is the process of using a unidirectionally adjustably resistant recoiler for exercise, specifically for human exercise. Although some of the above devices (notably Caramella) provide unidirectional adjustable resistance and recoiling, none of the references teaches combining a recoiler device with unidirectional adjustable resistance to provide human exercise.

As used herein, a recoiler shall be deemed to be any device that provides a restoring force to recoil a cord after the device is unwound by pulling on the cord, and a unidirectionally adjustably resistant recoiler shall be deemed to be a recoiler that also provides adjustable resistance only in one direction, preferably the unwinding direction.

A preferred embodiment of a device of the present invention preferably comprises an unwindingly projecting recoiler that projects an engageable member when rotated in an unwinding direction by an unwinding force (and preferably provides a slight restoring force when the unwinding force is released), and an unwindingly engaging adjustable friction means that engages the engageable member only when the recoiler rotates in an unwinding direction, and that provides adjustable friction against the unwinding force when so engaged. Preferably, the friction means disengages when the recoiler rotates in the winding direction. Preferably the recoilers comprise spring-operated recoilers, and preferably the spring operated recoilers are unwindingly engageably coupled to adjustably resistant friction wheels. Optimally the spring-operated recoilers comprise mechanical hand starters.

The upper body exercise device of the present invention comprises a base, two unidirectionally adjustably resistant recoilers mounted on the base, right and left extension members mounted on the base and extending outwardly and downwardly from either side of the base, right and left pulleys mounted on the outer ends of the extension members, cords with handles threaded through the pulleys and operatively connected to the unidirectionally adjustably resistant recoilers, and carrying means for carrying the base. Preferably, he carrying means comprises a waist pouch, commonly known as a "fanny pack."

Alternatively, the device comprises a base having right and left extension members extending outwardly and downwardly from the base with right and left pulleys mounted on the outer ends of the extension members and with a single cord threaded through the pulleys with handles at both ends, optional adjustable resistance means operatively connected to the cord, and carrying means for carrying the base. The adjustable resistance means could either be provided at the pulleys, such as a device that resists rotation of the pulleys, or could be provided at some other location, such as a device operatively connected directly to the cord to provide resistance, such as an eyehook or braking device between the pulleys and through which the cord is threaded.

In another alternative embodiment, four sets of unidirectionally adjustably resistant recoilers, extension arms and pulleys can be mounted on a base, two of the extension arms extending upwardly on either side, and two on the extension arms extending downwardly on either side, and the base can be carried inside a conventional backpack.

In still another alternative embodiment, two or four unidirectionally adjustably resistant recoilers, extension arms and pulleys can be attached to a reclining pedaling device so that a user can exercise the upper body while pedaling.

Other objects, features and advantages of the present invention will become more fully apparent from the following detailed description of the presently preferred embodiments for carrying out the invention, the claims and the accompanying drawings.

BRIEF DESCRIPTION OF DRAWINGS

FIG. 2(*b*) is a rear elevational view of the embodiment shown in FIG. 1 in which the pulleys are suspended downward and the waist pouch is omitted for clarity;

FIG. 3(*b*) is a top plan view of the tongues and recoil wheel hub of FIG. 3(*a*) in operative relationship;

FIG. 4 is a rear perspective view of a runner wearing the embodiment of FIG. 1;

BEST MODES FOR CARRYING OUT INVENTION

The best modes presently contemplated for carrying out the present invention are the presently preferred embodiments illustrated by way of example in FIGS. 1 through 8.

Figure 1:
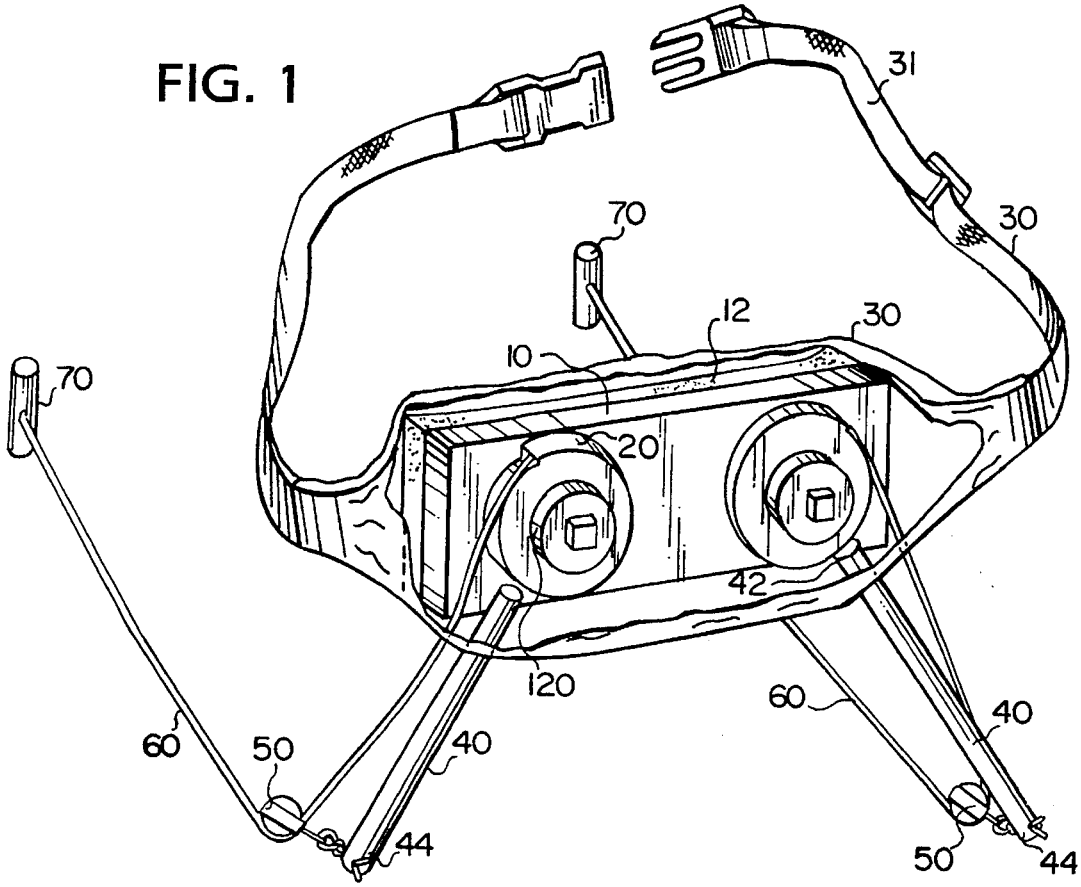
FIG. 1 is a perspective cutaway view of a first presently preferred embodiment of the exercise device of the present invention.

FIG. 1 shows a base 10, on the front side of which is mounted a preferably foam rubber lumbar support 12, and on the rear side of which are mounted two unidirectionally adjustably resistant recoilers 20 contained in a waist pouch 30 of conventional construction. Preferably the straps 31 for the waist pouch 30 are vertically centered on the pouch 30, that is, they are attached midway between the top and bottom of each side of the pouch 30.

Two extension members 40 are preferably attached at their base ends 42 to each of the right and left sides of the base 10 and preferably extend outwardly and downwardly from the base 10 through holes cut in the waist pouch (not shown), preferably at between the 4 and 5 o'clock and 7 and 8 o'clock positions, optimally at approximately the 4 o'clock and the 8 o'clock positions.

Preferably, two pulleys 50 are swivelably attached at or near the outer ends 44 of the extension members 40. Preferably, flexible non-stretchable cords 60 recoilably extend from the recoilers 20 and are threaded through the pulleys 50. It is presently preferred that the cord 60 be between 140 centimeters and 230 centimeters long. Preferably, handles 70 are provided at handle ends of the cords 60.

Figure 2A:
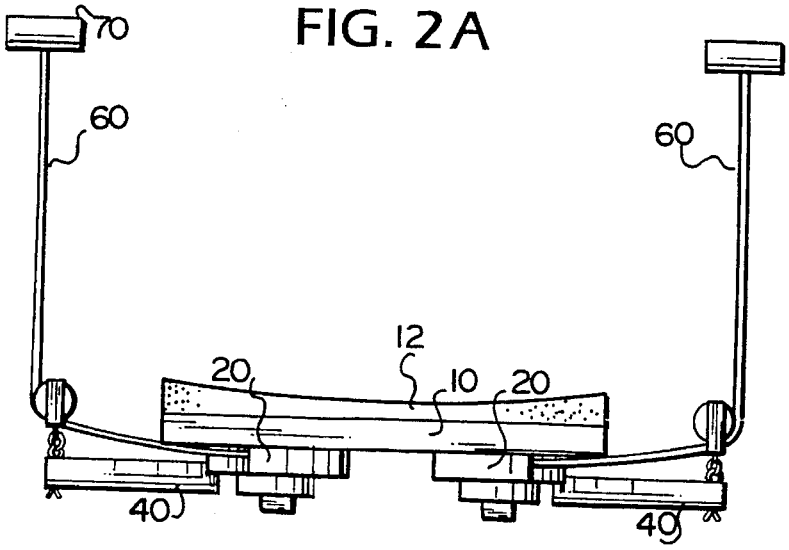
FIG. 2(*a*) is a top plan view of the embodiment shown in FIG. 1 in which the waist pouch is omitted for clarity.
Figure 2B:
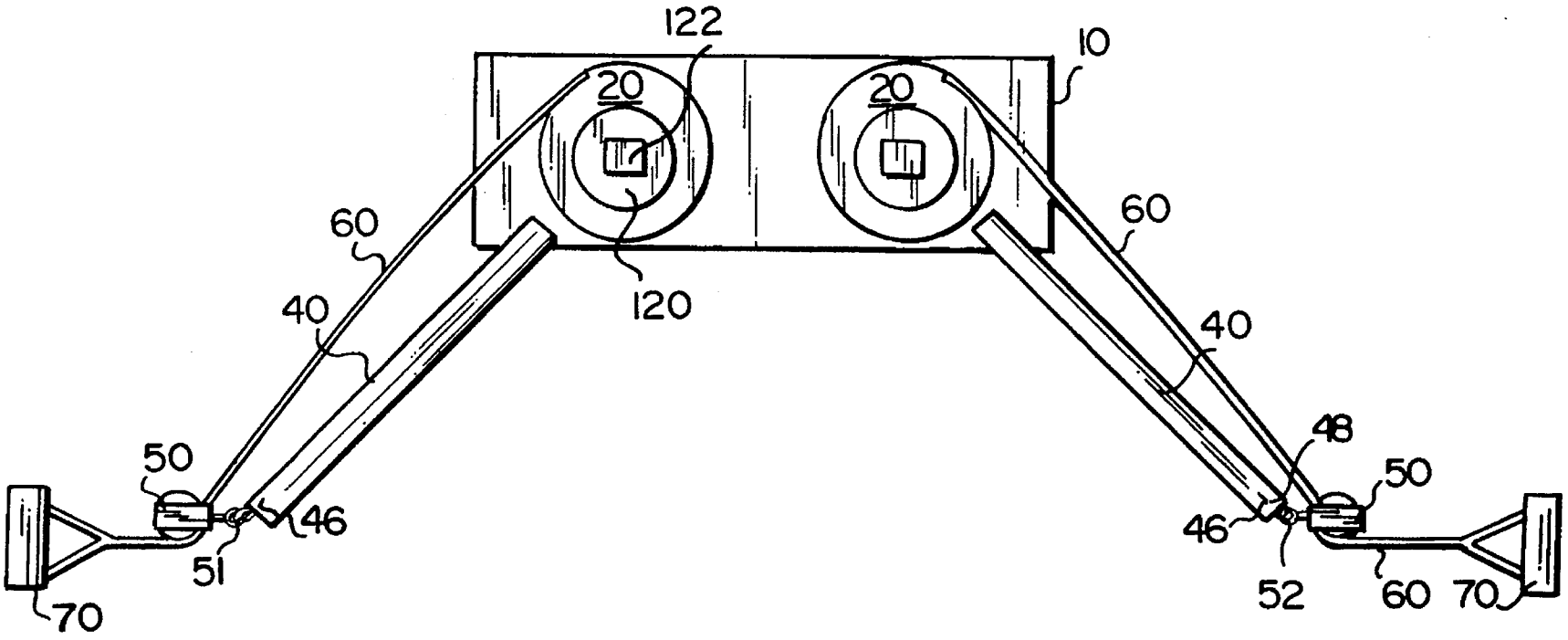

Referring to FIG. 2(*a*), preferably, the cords 60 are in front of the extension members 40 to avoid chafing of the cords 60 against the extension members 40. Preferably also, the base ends 42 of the extension members 40 are mounted below the recoilers 20, again to avoid chafing of the cords 60 against the extension members 40.

Preferably, the unidirectionally adjustably resistant recoilers 20 provide an adjustable resistance force when the cords 60 are pulled outward by a user pulling on the handle 70. The preferred range of adjustable resistance is between 1 and 200 pounds, optimally between 1 and 30 pounds. Thus, a user will gain exercise when the cord 60 is pulled. Further, it is preferred, but not required, that the recoiler provide only a slight restoring force that is sufficient to recoil the cord 60 when the user's tension is released (regardless of the resistance force applied when the handles 70 are pulled), so that the cord 60 will be in position to provide tension again when the user pulls on the handle 70 again.

The user will usually be moving his or her hands in the direction that the cord is being recoiled when tension is released, so that the user will not experience a substantial portion of the restoring force applied by the recoiler. Thus, to the user, the preferred recoilers 20 provide "one way" resistance, or unidirectional resistance, that is, resistance in only one direction; no resistance is offered in the opposite direction because of the restoring force. For example, the preferred recoilers provide a resistance force when the user moves his or her hands forward (thus pulling the handles 70 forward), and no resistance force when the user moves his or her hands backwards (because the hands are moving in the same direction as the restoring force that is recoiling the cord 60).

Preferably the restoring force for recoiling the cord 60 is provided by a spring that is wound up when the cord 60 is pulled, so that the wound up spring provides a restoring force to recoil the cord 60 when the cord 60 is released. Any recoiler using a spring to provide restoring force is referred to as a "spring operated recoiler."

The preferred adjustable resistance force provided by the recoiler is preferably a frictional force that can be adjusted through a desired range of resistance, preferably by an unwindingly engaging friction means, more preferably an unwindingly engaging rotatable friction wheel in adjustable frictional contact with a fixed friction plate, so that the friction wheel is engaged when the recoiler rotates in an unwinding direction, but is disengaged when the recoiler rotates in a winding direction. Thus, when a recoiler is operatively connected to an unwindingly engageable adjustable friction wheel, the recoiler provides an adjustable frictional resistance when a user pulls on the handles 70, but the recoiler does not provide a resistance force, and provides a restoring force sufficient to recoil the cords 60, when the user's hand stops pulling on the handles 70 and moves in the opposite direction. This combination thus creates a unidirectionally adjustably resistant recoiler.

It is not necessary to provide an adjustable frictional resistance if the desired resistance force is of the same order as the restoring force necessary to recoil the cord 60. Thus, the invention could be practiced with recoilers that do not include adjustable resistance. This may be preferred where what is desired is a slight resistance force that is equal to the restoring force applied by spring operated recoilers.

Alternatively, the invention could be practiced with a unidirectional constant resistance force greater than the restoring force, instead of a unidirectional adjustable resistance force. This may be preferred where a constant resistance force is all that is desired, but the desired resistance force is greater than the restoring force applied by the recoilers 20.

Referring to FIG. 2(*a*), shown is a top plan view of the base 10 with the lumbar support 12 attached to the front surface, showing the unidirectionally adjustably resistant recoilers 20 and the extension arms 40, but with the waist pouch 30 omitted for clarity. The extension arms 40 preferably extend somewhat rearwardly and then forwardly so that the cords 60 avoid contact with, and chafing against, the extension arms 40. As can be seen, when the user pulls the handles 70, the pulleys 50 are pulled in the forward direction and preferably swivel forwardly, as shown below.

Referring to FIG. 2(*b*), shown is a rear elevational view of the base 10, unidirectionally adjustably resistant recoilers 20 and extension arms 40, with the pulleys 50 hanging downwardly and the waist pouch 30 omitted for clarity. Preferably, the openings in the recoilers 20 for the cords 60 face away from each other and are preferably placed at the 2 o'clock and 10 o'clock positions. As can be seen, the pulleys 50, preferably marine pulleys (such as Ronstan "mini" series 28 pulleys #54341) are provided with swivelable attachment means, such as rotatably mounted posts 51 to which rings 52 are swivelably attached. Preferably, also, cotter pins 46 are engaged in pulley apertures 48 at the outer ends 44 of the extension members 40 so that the pulleys 50 can freely swivel and move in all directions while being attached to the outer ends 44 of the extension arms 40. Of course, the manner of attachment of the pulleys 50 to the extension arms 40 is not critical, as long as the pulleys 50 can accommodate the range of motion that will be imposed on the cord 60 while the device is being used. Thus, although it is preferred that the pulleys 50 be swivelably attached, this is not critical, so that the pulleys 50 could, for example, be fixedly attached.

Similarly, it is not critical that the pulleys 50 be attached at the extreme ends of the extension members 40, as long as the pulleys 50 are positioned comfortably for the user. For example, the pulleys 50 could be slidably or adjustably connected to the extension members 40 so that they are positioned a suitable distance away from the base 10.

The extension arms 40 need not be rigidly attached to the base 10. Instead, they can be rotatably or angularly adjustably attached so that their height with respect to the user's waist and arms can be varied as the user desires. However, it is preferred that the extension members be at approximately the 4 o'clock and 8 o'clock positions, although they could be at the 5 o'clock or 7 o'clock positions or other positions.

Figure 3A:
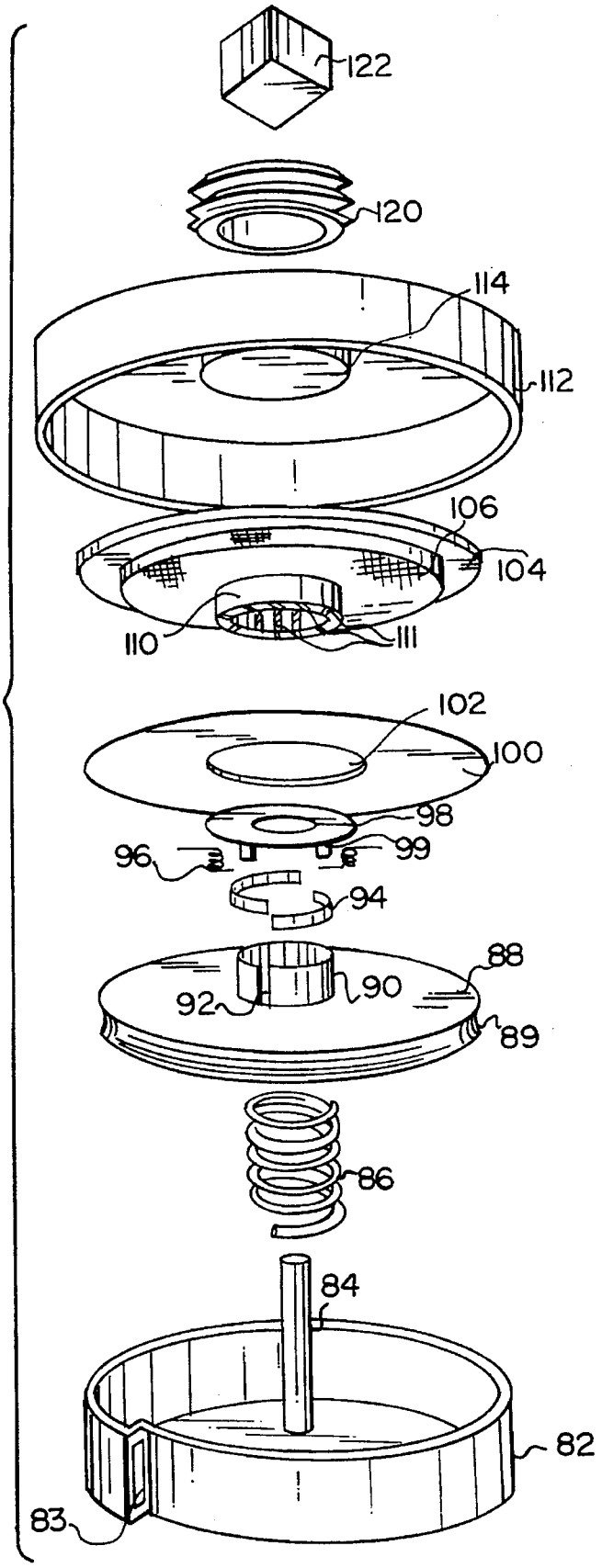
FIG. 3(*a*) is an exploded view of the presently preferred unidirectionally adjustably resistant recoiler in the embodiment of FIG. 1.

Referring to FIG. 3(*a*), shown is an exploded schematic view of a presently preferred embodiment of one of the unidirectionally adjustably resistant recoilers 20. The recoiler 20 comprises a housing 82 with a recoil axle 84 mounted in the center of the housing 82. A recoil spring 86 is preferably mounted over the recoil axle 84 and attached to a recoil wheel 88 having a circumferential groove 89 that is rotatably mounted on the recoil axle 84. Preferably, the recoil wheel 88 is provided with an axially extending hollow hub 90 having two diametrically opposed tongue apertures 92. As explained in more detail below and in FIG. 3 (*b*), preferably two tongues 94 (or "dogs") are springingly mounted inside the hub 90 with tongue springs 96 so that the tongues 94 extend outwardly through the tongue apertures 92 when the recoil wheel 88 is rotated in an unwinding direction, and the tongues 94 retract inwardly through the tongue apertures 92 when the recoil wheel 88 is rotated in a winding direction. Preferably a hub cover 98 having two preferably diametrically opposed downwardly extending tongue actuating members 99 is rotatably draggingly mounted on top of, and encloses, the hub 90. The hub cover 98 is preferably able to rotate with respect to the hub 90 with some drag, and is preferably rotatably mounted on the recoil axle 84.

Preferably, a friction wheel 104 rotatably mounted adjacent to the recoil wheel 88.

A friction plate 100 is preferably fixedly mounted adjacent to the friction wheel 104 (but not in contact with the recoil wheel 88). Preferably, the friction plate 100 has a central space 102 with a diameter greater than the diameter of the hub 90 and is fixedly mounted between the friction wheel and the recoil wheel 88. Preferably, the friction plate 100 comprises a metal such as steel or tin.

Preferably, a ring shaped brake pad 106 (preferably a steel mesh cleaning pad, optimally a "Scotch Brite" cleaning pad) is attached to the friction wheel 104 and is in frictional contact with the friction plate 100 (which is preferably made of a metal, such as 16 gauge sheet metal steel). Preferably, an engagement tube 110 having between 5 and 15 (but preferably 10) keyways 111 on the interior surface is attached to the friction wheel 104 and extends downwardly through the central space 102 and over the hub 90, so that the keyways 111 circle the tongue apertures 92 as the engagement tube 110 rotates when the friction wheel 104 rotates. It is preferred that the keyways 111 not extend through the material of the engagement tube 110, but rather be depressions in the interior wall of the engagement tube, so that the tongues 94 can rapidly and freely engage and disengage with the keyways 111, while still providing a stronger engagement than mere friction. Mere frictional engagement between the recoil wheel 88 and the friction wheel 104 is not preferred because, if the friction between the friction wheel 104 and the friction plate 100 were adjusted to be higher than such a frictional engagement between the recoil wheel 88 and the friction wheel 104, the frictional engagement between the recoil wheel 88 and the friction wheel 104 would slip at their lower friction, thereby preventing the use of the higher friction between the friction wheel 104 and the friction plate 100.

Preferably, the engagement tube 110 and the friction wheel 104 are integrally formed. The engagement tube 110 must have a sufficiently large diameter to fit over the hub 90, but a sufficiently small diameter that it fits through the central space 102 and the tongues 94 can project into and engage the keyways 111 when the tongues 94 extend outwards through the tongue apertures 92, thereby engaging the recoil wheel 88 with the friction wheel 104, so that the friction wheel 104 creates frictional resistance as the recoil wheel 88 rotates. The brake pad 106 alternatively could be rubber or some other material in order to provide a different range of coefficients of friction.

A recoiler top 112 having a preferably threaded control knob aperture 114 is preferably placed over the housing 82 to enclose the recoil wheel 88, the friction plate 100 and the friction wheel 104. A threaded control knob 120 is preferably threadingly engaged with the control knob aperture 114 and in axially pressurable contact with the friction wheel 104 so that increased axial pressure applied by the control knob 120 to the friction wheel 104 increases the pressure of the brake pad 106 against the friction plate 100. Preferably, a square or other polygonal knob 122 is mounted on top of the control knob 120 for ease of gripping and turning. Thus, the frictional force between the friction pad 106 and the friction plate 100 is adjustable by rotating the handle 120.

Referring to FIG. 3(*b*), shown is a top plan view of the tongues 94 inside the hub 90 in operative relationship with the tongue springs 96. As can be seen, the tongues 94 are pivotably mounted inside the hub 90 so that they can extend outward through the tongue apertures 92. Preferably, the tongues 94 are biased in the retracted position by the tongue springs 96.

Thus, when the recoil wheel 88 and the hub 90 rotate in the unwinding direction, the tongue actuating members 99 projecting downwardly from the hub cover 98 engage with the tongues 94. As the recoil wheel 88 continues rotating in the unwinding direction, the drag from the hub cover 98 causes the tongue actuating members 99 to remain stationary while the tongues 94 are pushed against them, overcoming the bias of the tongue springs 96, and causing the tongues 94 to extend through the tongue apertures 92. The tongues 94 then engage with the keyways 111. When the tongues 94 are fully extended through the tongue apertures 92, they cannot be moved any further and further unwinding of the recoil wheel 88 overcomes the drag on the hub cover 98, so that the hub cover 98 rotates together with the recoil wheel 88 and hub 90.

When the recoil wheel 88 is rotated in the winding direction by the recoil spring 86, the drag on the hub cover 98 causes the tongue actuating members 99 to remain stationary, so that the tongues 94 move away from the tongue actuating members 99. The bias of the tongue springs 96 then causes the tongues 94 to retract through the tongue apertures 92. Because the tongues 94 are retracted, they withdraw from the keyways 111 as the recoil wheel 88 continues to wind. Thus, the recoil wheel 88 becomes disengaged from the friction wheel 100 when the recoil wheel rotates in the winding direction.

In operation, a recoiler end of a cord 60 is attached to the recoil wheel 88 and received in the circumferential groove 89 and wound around the recoil wheel 88 so that the outer end extends through the cord aperture 83 in the housing 82. A handle 70 is then attached to the outer end of the cord 60. When the user pulls on the handle 70, tension is applied to the cord 60 and the recoil wheel 88 is rotated in the unwinding direction. This unwinding rotation causes the tongues 94 to extend outwardly from the hub 90 and extend into the keyways 111, thereby causing the recoil wheel 88 to engage the friction wheel 104. The engagement of the recoil wheel 88 by the friction wheel 104 causes the friction wheel 104 to provide a frictional force against the pulling of the cord 60 as long as tension is applied to the cord 60. Of course, the unwinding of the recoil wheel 88 also creates a restoring force from the recoil spring 86 so that the user must counteract both the restoring force and the frictional force in order to pull the handles 70 and the cord 60 outwards from the recoiler 20.

When tension on the cord 60 is released, the restoring force from the recoil spring 86 causes the recoil wheel 88 to rotate in the winding direction, which in turn causes the tongues 94 to retract through the tongue apertures 92 in the hub 90. Because the tongues 94 are retracted, they do not engage with the keyways 111. Thus, the recoil wheel 88 disengages from the friction wheel 104 and the restoring force created by the recoil spring 86 recoils the cord 60 free of any fictional force that may be generated by the friction wheel 104. Further, because of the restoring force, there is no resistance force against the user.

The recoiler 20 therefore provides unidirectional adjustable resistance when a user pulls the handle 70, and a restoring force that recoils the cord 60 when the tension is released. The frictional force created by the recoiler 20 can be adjusted as desired by the user merely by rotating the handle 120 to increase or decrease the frictional force between the friction wheel 104 and the friction plate 100. The restoring force is determined by the spring constant of the recoil spring 86, but is preferably slight, being only sufficiently strong to rewind the cord 60 as fast as the user's arms are moving.

It is preferred that the recoiler 20 be partially unwound when the handle 70 abuts against the pulley 50, so that the recoil spring 86 provides a restoring force and the cord 60 is under mild tension when the device is not being used. This is preferred because it will retain the handles 70 abutting against the pulleys 50 or convenience of storage and a compact configuration.

The tension necessary to pull the cord can be additionally adjusted by shortening the length of the cord 60 by winding it around a user's hands after grasping the handles 70. This would partially wind up the recoil spring 86 to provide a greater restoring force than if the recoil spring 86 were completely unwound.

Referring to FIG. 4, shown is a rear perspective view of the presently preferred embodiment of the present invention as used by a runner. The recoilers 20 are contained within the waist pouch 30, and two holes are provided for access to the polygonal knobs 122 so that a user can adjust the resistance without opening the pouch 30. As can be seen, the frictional force FF applied by the unidirectionally adjustably resistant recoilers 20 is directed through the pulleys 50 at the outer ends 44 of the extension members 40. Because of this redirection and displacement of the frictional force FF downwards and outwards from the user's waist, the user can employ his or her normal running motion with the upper body. By contrast, if any of the prior art belt mounted devices are used, the frictional force is directed inwards towards the waist, which may impose chafing, balance and other problems because the direction of the frictional force is not coincident with the direction of natural motion of the user's hands or arms.

Obviously, the length and orientation of the extension members 40 can be adjustable so that the user can determine the most comfortable or effective placement and direction of the frictional force created by the device.

Because the entire device is housed in a waist pouch, it is easily put on for use and taken off after use. Further, because waist pouches are commonly used during athletic activities and the extension arms and cords are relatively unobtrusive, the device is not as aesthetically awkward or unappealing as some of the prior art exercisers.

The preferred unidirectionally adjustably resistant recoiler comprises a starter, such as is used to engines, manually start small internal combustion engines, unwindingly engageable with an adjustable friction wheel. The particular starter that is presently preferred is manufactured by Tecumseh Products Company and is Model No. 590694. The presently preferred waist pouch is an L. L. Bean fanny pack No. Q545. The base is presently preferably made of plywood with a preferably foam rubber lumbar support 12.

It is preferred that two independent mirror image recoilers be provided because a user's arms will probably move independently during exercise such as, for example, if the user needs to jump or otherwise deviate from a single constant running motion. Although the two recoilers 20 are preferably positioned side by side, this configuration is not critical and they could be placed, for example, on top of each other.

Although it is preferred to provide two independent handles, cords and recoilers, in order to save costs and for users who will primarily be employing a constant series of motions in their athletic activity, it is possible to omit the recoilers and to use a single cord with handles at both ends so that the restoring force on one end is provided by tension applied at the other end. Thus, FIG. 5 discloses an alternative embodiment in which a base 210 has extension members 240 extending downwardly and outwardly with pulleys 250 preferably swivelably mounted at the outer ends 244 of the extension members 240. Except as specified herein, the other preferred parameters of the invention are the same as for the previously described embodiment. In this embodiment, a single cord 260 is preferably threaded through the two pulleys 250 and handles 270 are provided at both ends. Thus, if the user applies tension to one handle 270 to extend the cord 260 on one side, the cord 260 and handle 270 on the opposite side will be retracted. Because the cord 260 must necessarily travel through the pulleys 250, the device inherently provides a frictional force whenever one of the handles 270 is moved forward. However, if it is desired to adjust or increase the frictional force, adjustable resistance means can be operatively connected to the cord, such as by providing braking devices at either the pulleys or elsewhere. Indeed, in its simplest embodiment, the pulleys can be completely eliminated and the cord 260 can be run only through eye hooks attached at the outer ends 244 of the extension members 240.

Figure 5:
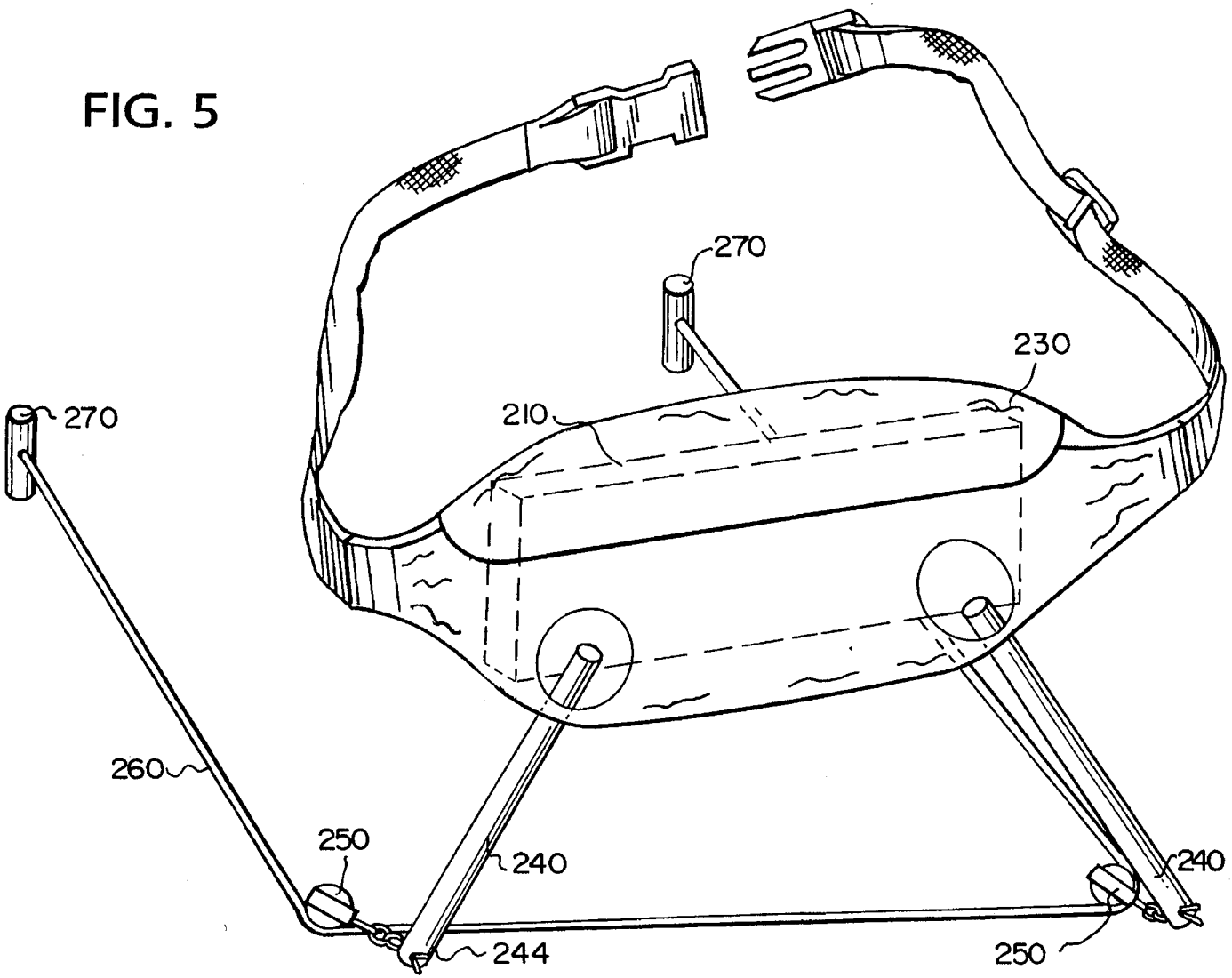
FIG. 5 is a perspective cutaway view of an alternative embodiment that does not use recoilers but instead uses the restoring force of the user's opposing arm motions and adjustable resistance.

The alternative embodiment of FIG. 5 provides the benefits of displacing and directing the frictional force applied by the cord downwards and outwards from the user's waist, but does not provide the ability to move the handles 270 independently of each other. Nevertheless, this alternative embodiment may be preferred under certain circumstances, such as for cheaper manufacture.

Figure 6:
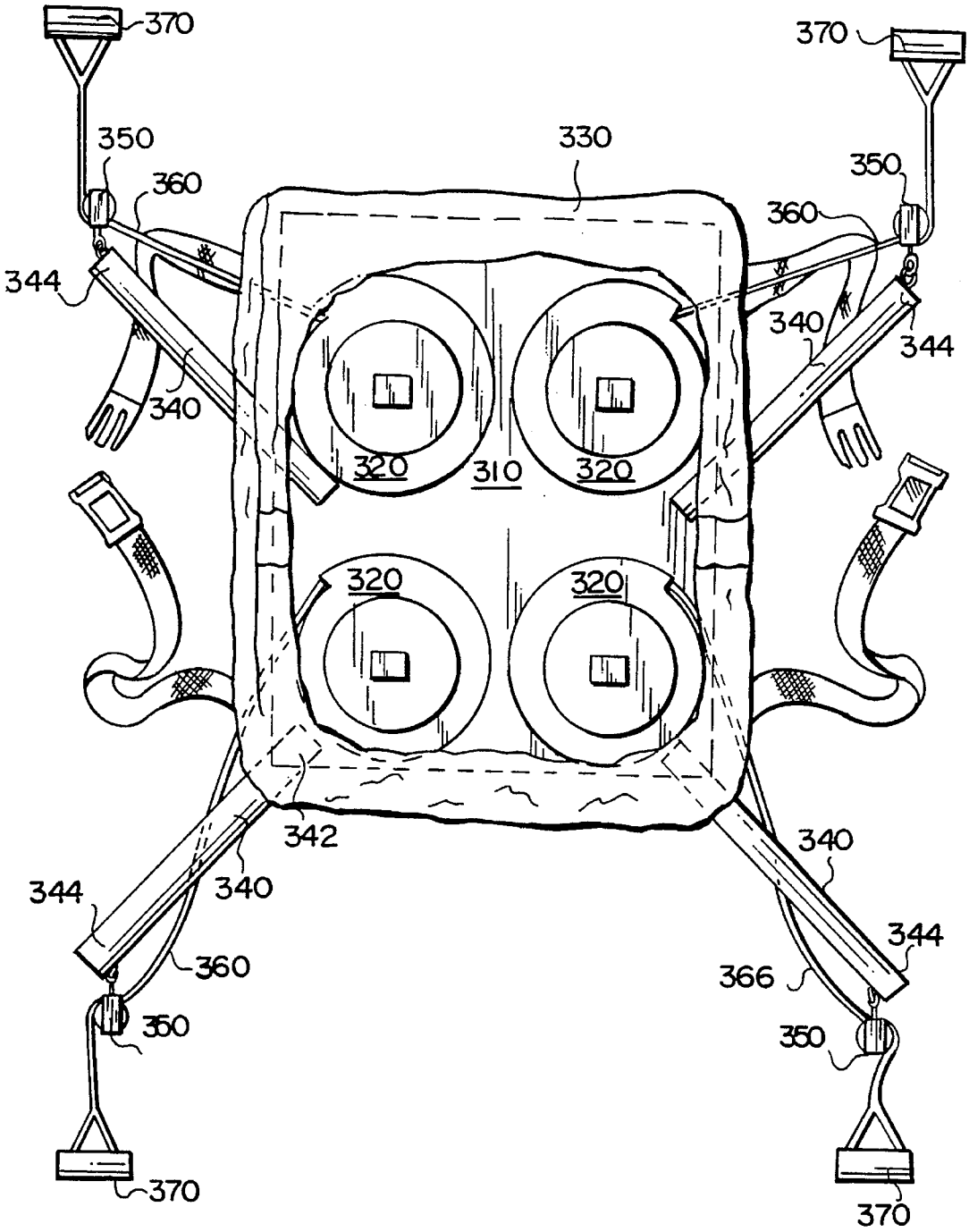
FIG. 6 is a rear elevational cutaway view of an alternative embodiment in which four sets of recoilers, extension arms and pulleys are attached to a base that is carried in a backpack.

Referring to FIG. 6, shown is another alternative embodiment having a base 310 on which are mounted four unidirectionally adjustably resistant recoilers 320 contained in a backpack 330 of conventional construction.

Four extension members 340 are preferably attached at their base ends 342 to each of the right and left sides of the base 310 at both the top and the bottom, that is, the extension members extend outwardly from each of the upper right, upper left, lower right and lower left quadrants. The top set of extension members 340 preferably extends upwardly and outwardly from the base 310, optimally at approximately the 2:00 o'clock and 10:00 o'clock positions. The lower set of extension members 340 preferably extends outwardly and downwardly from the base 310, optimally at approximately the 5 o'clock and 7 o'clock positions.

Preferably a pulley 350 is swivelably attached near the outer end 344 of each of the extension members 340. Preferably, flexible non-stretchable cords 360 recoilably extend from the recoilers 320 and are threaded through the pulleys 350. It is presently preferred that the cords 360 be between 140 centimeters and 230 centimeters long. Preferably, handles 370 are provided at handle ends of the cords 360.

Preferably, the recoilers 320 are similar to the recoilers in the embodiment of FIG. 1 and provide an adjustable resisting force when the cords 60 are pulled outward by a user pulling on the handle 70, and provide a slight restoring force to recoil the cord 360 when the user's tension is released.

In the operation of this embodiment, the user has the option and ability to use the handles 370 extending from either the upper or lower set of extension members 340, or to use handles 370 extending from diagonally opposite extension members 340. The added weight of an extra set of recoilers 320, extension members 340 and pulleys 350 is not a major concern because it is a common practice for users to wear backpacks with weights during running, jogging or skating in order to provide additional exercise.

Figure 7:
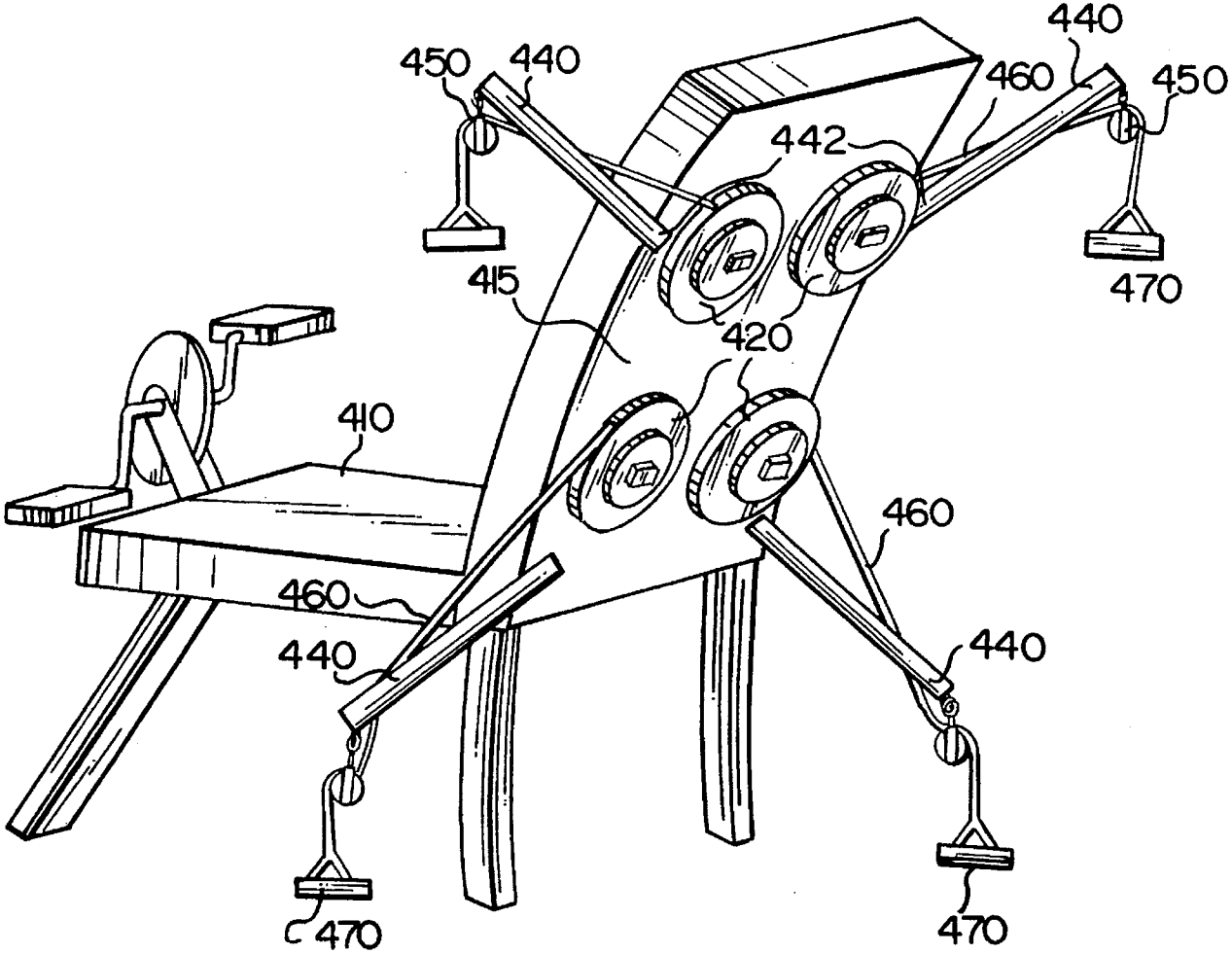
FIG. 7 is a rear perspective view of an alternative embodiment in which the adjustably resistant recoilers of FIG. 3(*a*) are used in conjunction with a reclining pedaling device.

Referring to FIG. 7, shown is a rear perspective view of still another alternative embodiment of the present invention, in which a conventional reclining pedaling exercise device 410 has four unidirectionally adjustably resistant recoilers 420 attached to the back. Four extension members 440 are preferably attached at their base ends 442 to each of the right and left sides of the seat back 415 at the top and the bottom. Preferably, the top set of extension members 440 extends outwardly and upwardly from the seat back 420, optimally at approximately the 2 o'clock and 10 o'clock positions, and the lower set of extension members 440 preferably extends outwardly and downwardly from the seat back 415, optimally at approximately the 5 o'clock and the 7 o'clock positions. As is the case in the embodiment of FIG. 6, pulleys 450 are preferably provided at the outer ends of each of the extension members 440 and flexible non-stretchable cords 460 having handles 470 attached at the ends are threaded through the pulleys 450.

The configuration of the extension members 440 in this embodiment is very similar to the configuration of the extension members 340 in the embodiment of FIG. 6, so that the operation of the handles 470 in the embodiment of FIG. 7 is basically the same as the operation of the handles 370 in the embodiment of FIG. 6.

Figure 8:
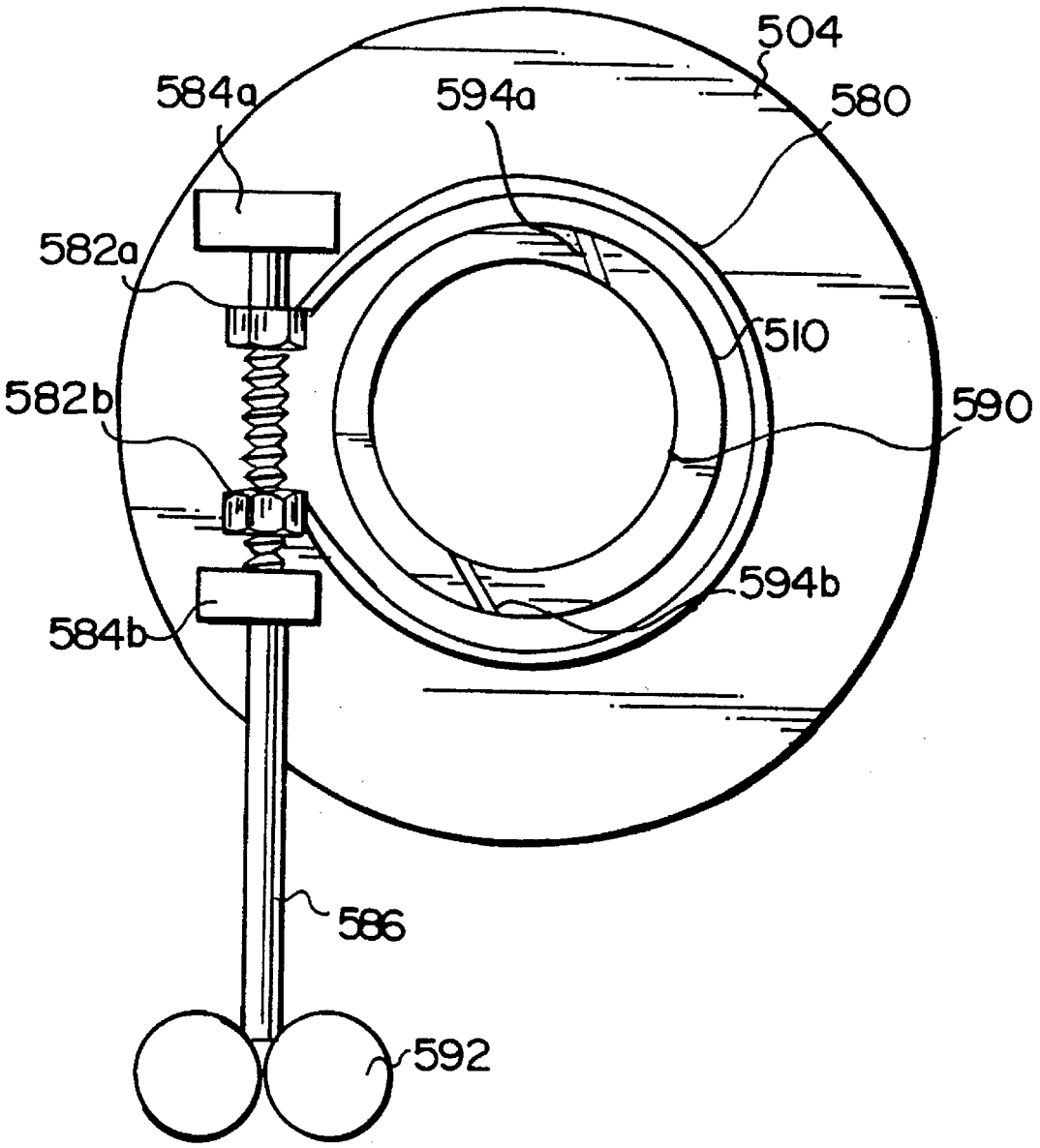
FIG. 8 is a rear elevational view of an alternative embodiment of a unidirectionally adjustably resistant recoiler in which tension on a strap provides resistance.

FIG. 8 shows an alternative embodiment of a unidirectionally adjustably resistant recoiler in which resistance is provided by tightening a strap. In this embodiment, a friction wheel 504 having a preferably integrally formed engagement tube 510 is rotatably mounted, preferably coaxially, adjacent to a recoil wheel (not shown) so that when tongues 594*a* 594*b* extend outwards from a hub 590, they engage keyways (not shown) in the engagement tube 510, as in the above embodiments. A tightening strap 580 is looped around the exterior circumference of the engagement tube 510; the ends of the strap 580 are attached to nuts 582*a* 582*b* on a screw 586. Preferably the screw 586 has wings 592 at one end, and preferably the wings 592 protrude out the bottom of the waist pouch (not shown). The screw 586 is mounted on the housing by screw mounts 584*a* 584*b*. Thus, turning the wings 592 turns the screw 586, which in turn tightens the strap 580.

The unidirectionally adjustably resistant recoiler 20 provides a beneficial safety feature because it creates a widely adjustable resistance force to tension applied by the user, yet offers no resistance and applies a slight restoring force when the user's tension is released. In most other exercise devices that use elastic cords, cams or weights to provide resistance, the restoring force applied by the device is equal to the tension or other displacing force applied by the user. Thus, if a user applies 500 pounds of tension or compression against a conventional exercise device, when the user stops applying this displacing force, the device will apply a 500 pound restoring force against the user. The device pushes (or pulls) back as hard as the user pushes (or pulls) the device. This "backlash" can be quite dangerous, especially because, by definition, users become fatigued while using exercise devices, and may perspire profusely. The combination of perspiration and fatigue may cause a user to accidentally release an exercise device, in which case an equal restoring force will be applied to the device. If any portion of the user's body is then close to the device, the user may be injured or killed. It is very well known that, when using free weights, a user should have "spotters" close by to control and hold the weights if the user should lose control. Without such spotters, the weights could fall on the user and cause serious injury or death.

The danger of injury where a restoring force equal to the displacing force is created by the equipment is not merely theoretical. In heavy exercise, by definition, the user is straining as hard as possible against a resistance force. After applying such a strain, the user's strength and coordination are very likely to be impaired so that the user may not have sufficient strength or coordination to either control the restoring force or avoid injury when the device returns to its initial condition.

By contrast, in the present device, a unidirectional adjustably resistant force of virtually any magnitude can be provided in a compact unit when tension is applied, but when the tension is released, a slight restoring force can be provided. Thus, for example, one of the present devices can be set to provide a resistance force of 500 pounds, yet the restoring force can be as little as one pound. This would eliminate or greatly reduce possible dangers caused by backlash if a user's grip on a handle unexpectedly slips.

Because of these safety advantages, the unidirectionally adjustably resistant recoiler of this device can be used to substitute for any of the other conventional mechanisms used to provide a resistant force for exercise. Thus, the unidirectionally adjustably resistant recoilers of the present invention can be used instead of elastic bands, springs, cams, weights or other devices.

The invention has been described with respect to the particular presently preferred embodiments described above. It will be appreciated by those skilled in the art that changes and modifications can be made to these embodiments without departing from the spirit and scope of the invention. For example, instead of flexible non-stretchable cords moving back and forth over pulleys or eye hooks, the invention could be practiced using stretchable cords that are merely attached to the outer ends of the extension members. For a further example, levers can be used instead of cords. Accordingly, no limitations are to be inferred or implied in the scope of the invention except as specifically and explicitly set forth in the attached claims.

INDUSTRIAL APPLICABILITY

The unidirectionally adjustably resistant recoiler of this invention can be used in any exercise activity in which it is desired to provide a variable resistance force in one direction, but a substantially constant slight restoring force in the opposite direction. The exercise device of this invention can be used in any lower body intensive activity in which it is desired to provide exercise for the upper body.

What is claimed is:

1. A process, comprising:

using a unidirectionally adjustably resistant recoiler to provide resistance for exercise, wherein said using step is carried out with a device comprising:

unwindingly projecting recoiler means for projecting an engageable member when rotated in an unwinding direction by an unwinding force, and for providing a restoring force when said unwinding force is released; and unwindingly engaging adjustable friction means for engaging said engageable member only when said recoiler means rotates in an unwinding direction, and for providing adjustable friction against said unwinding force when so engaged, unwindingly engageably coupled to said recoiler means;

wherein said unwindingly projecting recoiler means comprises:

a housing;

a recoil axle mounted in said housing;

a recoil spring having a housing portion and a wheel portion anchored at said housing portion to said housing;

a recoil wheel having an axially projecting hub portion with a tongue aperture, mounted on said recoil axle and attached to said wheel portion of said spring, whereby said recoil spring provides a restoring force when said recoil wheel is rotated;

an extendable tongue extendably mounted in said hub portion adjacent to said tongue aperture;

tongue extension means for extending said tongue through said tongue aperture radially outwards from said hub when said recoil wheel is rotated in an unwinding direction, and for retracting said tongue through said tongue aperture when said recoil wheel is rotated in a winding direction.

2. A process according to claim 1, wherein said unwindingly engaging adjustable friction means comprises:

a friction wheel rotatably mounted adjacent to said recoil wheel;

a friction plate fixedly mounted adjacent to said friction wheel and in frictional contact with said friction wheel;

engagement means for engaging said extendable tongue only when said tongue is extended, whereby said friction wheel and said recoil wheel are engaged only when said tongue is extended;

frictional adjustment means for adjusting friction between said friction wheel and said friction plate; and a housing cover over said housing.

* * * * *